US010763604B2

(12) United States Patent
Hashiguchi et al.

(10) Patent No.: US 10,763,604 B2
(45) Date of Patent: Sep. 1, 2020

(54) PLUG, RECEPTACLE, AND CONNECTOR

(71) Applicant: JAPAN AVIATION ELECTRONICS INDUSTRY, LIMITED, Tokyo (JP)

(72) Inventors: Osamu Hashiguchi, Tokyo (JP); Kenta Ashibu, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/283,016

(22) Filed: Feb. 22, 2019

(65) Prior Publication Data

US 2019/0288420 A1 Sep. 19, 2019

(30) Foreign Application Priority Data

Mar. 13, 2018 (JP) ..... 2018-045275

(51) Int. Cl.
*H01R 12/71* (2011.01)
*H01R 13/04* (2006.01)
(Continued)

(52) U.S. Cl.
CPC ..... *H01R 12/716* (2013.01); *H01R 13/04* (2013.01); *H01R 13/112* (2013.01); *H01R 13/405* (2013.01); *H01R 13/50* (2013.01)

(58) Field of Classification Search
CPC ..... H01R 23/725; H01R 12/52; H01R 9/096; H01R 12/716; H01R 13/04; H01R 13/50; H01R 13/405; H01R 13/112
(Continued)

(56) References Cited

U.S. PATENT DOCUMENTS 7,410,364 B2 * 8/2008 Kishi ..... H01R 12/716 439/566
8,083,527 B2 * 12/2011 Takeuchi ..... H01R 13/26 439/65
(Continued)

FOREIGN PATENT DOCUMENTS

JP 2009-230945 A 10/2009
JP 2014-056762 A 3/2014
KR 2017-0129066 A 11/2017

OTHER PUBLICATIONS

Office Action issued in Taiwanese family member Patent Appl. No. 108105986, dated Oct. 31, 2019, along with an English translation thereof.
(Continued)

*Primary Examiner* — Gary F Paumen
(74) *Attorney, Agent, or Firm* — Greenblum & Bernstein, P.L.C.

(57) ABSTRACT

A plug for mating with a receptacle includes: an insulator that has an inner bottom surface, which is orthogonal to a mating direction of the plug; and a plurality of pin contacts secured to the insulator and aligned in an alignment direction, each of which includes a contact tab having a pair of planar surfaces of the contact tab on two mutually opposite sides thereof which are parallel to each other, the planar surface of the contact tab each forming a contact surface. The contact tabs stand up from the inner bottom surface in the mating direction, the contact surfaces being parallel to the alignment direction. A plurality of protrusions are formed in the insulator that stand up from the inner bottom surface in the mating direction, such that each of the protrusions is positioned between two of the contact tabs which are next to each other in the alignment direction.

5 Claims, 16 Drawing Sheets

(51) Int. Cl.
*H01R 13/50* (2006.01)
*H01R 13/405* (2006.01)
*H01R 13/11* (2006.01)

(58) Field of Classification Search
USPC ..... 439/74
See application file for complete search history.

(56) References Cited

U.S. PATENT DOCUMENTS 8,845,339 B2 * 9/2014 Ono ..... H01R 12/7052
439/74
8,986,027 B2 * 3/2015 Nishimura ..... H01R 12/707
439/181
8,992,233 B2 * 3/2015 Miyazaki ..... H01R 12/707
439/74
9,039,428 B2 * 5/2015 Sasaki ..... H01R 12/716
439/74
9,196,984 B2 * 11/2015 Ishida ..... H01R 12/7052
9,331,410 B2 * 5/2016 Obikane ..... H01R 13/02
9,985,366 B2 * 5/2018 Takeuchi ..... H01R 12/707

OTHER PUBLICATIONS

Chinese Office Action of family member Chinese patent application No. 201910149426.6, dated Apr. 20, 2020, along with English translation.
Office Action for Republic of Korea Application No. 10-2019-0022987, dated Jul. 8, 2020, together with English language Translation thereof.

* cited by examiner

PLUG, RECEPTACLE, AND CONNECTOR

TECHNICAL FIELD

The present invention relates to a connector, and especially relates to configurations of a plug and a receptacle that are mated with each other to constitute the connector.

BACKGROUND ART

Japanese Patent Application Laid Open No. 2009-230945 (published on Oct. 8, 2009, referred to as Literature 1 below) describes a connector including a plug and a receptacle. FIG. 1 illustrates the configuration of the plug described in Literature 1.

The plug includes a plurality of plug contacts 11 and a block 12. The plug contact 11 includes a contact portion 11*a* that comes into contact with a mating receptacle contact, a fixed portion (hidden and not seen in FIG. 1) that is fixed to the block 12, and a connection portion 11*b* that is connected to a board.

The plug contacts 11 are mounted such that the fixed portions are press-fitted to insertion holes (hidden and not seen in FIG. 1) of the block 12 and a required number of plug contacts 11 are aligned and held in the block 12.

SUMMARY OF THE INVENTION

As illustrated in FIG. 1, contact parts of pin contacts (plug contacts) are aligned with gaps interposed therebetween in an alignment direction of the pin contacts in a plug of related art. This brings a state that a part of a socket contact and a corner portion of an insulator, holding the socket contacts, for example, of a receptacle are fitted between pin contacts in a mating operation with respect to the receptacle. Thus, there have been a problem that mating operability is poor and a problem that pin contacts and socket contacts are deformed or damaged.

An object of the present invention is to provide a plug that prevents a part of a socket contact and a corner portion of a receptacle insulator, for example, of a receptacle from fitting between pin contacts, accordingly provides favorable mating operability, and thus can prevent deformation and damages of pin contacts and socket contacts. In addition to this, an object of the present invention is to provide a receptacle for mating with the plug and a connector that is composed of the plug and the receptacle.

According to the present invention, a plug for mating with a receptacle includes: an insulator that has an inner bottom surface, which is orthogonal to a mating direction of the plug; and a plurality of pin contacts secured to the insulator and aligned in an alignment direction, each of which includes a contact tab having a pair of planar surfaces of the contact tab on two mutually opposite sides thereof which are parallel to each other, the planar surface of the contact tab each forming a contact surface. The contact tabs stand up from the inner bottom surface in the mating direction, the contact surfaces being parallel to the alignment direction. A plurality of protrusions are formed in the insulator that stand up from the inner bottom surface in the mating direction, such that each of the protrusions is positioned between two of the contact tabs which are next to each other in the alignment direction.

According to the present invention, a receptacle for mating with a plug in a mating direction includes: a receptacle insulator; and a plurality of socket contacts that are secured to the receptacle insulator and aligned in a socket alignment direction. Each of the socket contacts includes a contact portion, a coupling portion, a spring portion, and a fixing portion, which are continuously connected in this order. The contact portion includes a pair of contact pieces, which are opposed to each other in an opposing direction and are elastically displaceable respectively in the opposing direction. The fixing portion is fixed to the receptacle insulator. The spring portion renders the contact portion displaceable in a direction parallel to the opposing direction with respect to the fixing portion. The pair of contact pieces and the spring portion are protruded to a same side in the mating direction with respect to the coupling portion and are positioned to be mutually shifted in the socket alignment direction. A groove having both wall surfaces which are opposed to each other is formed on the receptacle insulator, the groove extending in the socket alignment direction, and each of the pair of contact pieces is positioned on each of the both wall surfaces.

According to the present invention, a connector includes the plug and the receptacle which are described above. The spring portion is positioned on a position on which the spring portion does not interfere with the pin contact in mating of the plug and the receptacle.

The plug according to the present invention is configured such that the protrusion formed in the insulator is positioned between the contact tabs of the pin contacts which are next to each other among the plurality of pin contacts, which are aligned, and thus there is no gap between the adjacent contact tabs. Accordingly, a part of the socket contact and a corner portion of the receptacle insulator, for example, of the receptacle are not fitted between the contact tabs in a mating operation with respect to the receptacle. As a result, favorable mating operability can be obtained and deformation and damages of the pin contacts and the socket contacts can be prevented.

The receptacle according to the present invention is mated with the plug to constitute a connector, and the spring portion renders the contact portion of the socket contact displaceable in the direction parallel to the opposing direction of the pair of contact pieces. Accordingly, even if positional accuracy, in the direction in which contact force is applied (the inter-row direction), of the pin contact of the plug is poor, for example, the contact portion of the socket contact can absorb displacement. Thus, stable contact force between the pin contact and the socket contact can be obtained.

DETAILED DESCRIPTION OF THE EMBODIMENTS

Figure 1:
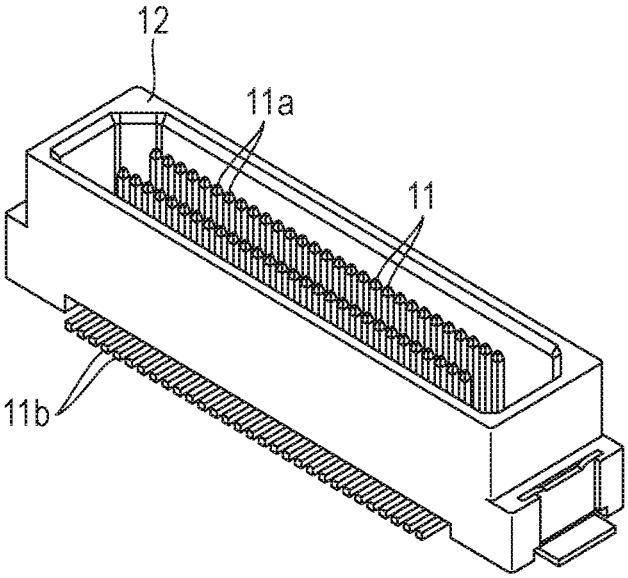
FIG.1 PRIOR ART
FIG. 1 is a perspective view illustrating a conventional example of a plug.

Embodiments according to the present invention are described below.

FIGS. 2A and 2B and FIGS. 3A to 3D illustrate a plug in a board to board connector used for electrically connecting boards to each other, as an embodiment of a plug according to the present invention. This plug 100 includes an insulator 20 constituting a housing, 24 pin contacts 40 which are arranged and secured to the insulator 20, and a pair of metal fittings 50 attached on a periphery of the insulator 20, in this example. The configuration of each component is first described.

The insulator 20 is made of heat resistant resin such, as liquid crystal polymer. In this example, the insulator 20 has a bottom plate portion 21 having a rectangular shape and lateral walls are formed on a peripheral edge of the bottom plate portion 21, as illustrated in FIGS. 4A and 4B and FIGS. 5A to 5C. The lateral walls are a pair of lateral walls 22 positioned on long side portions of the bottom plate portion 21 and a pair of lateral walls 23 positioned on short side portions of the bottom plate portion 21.

Figure 5A:
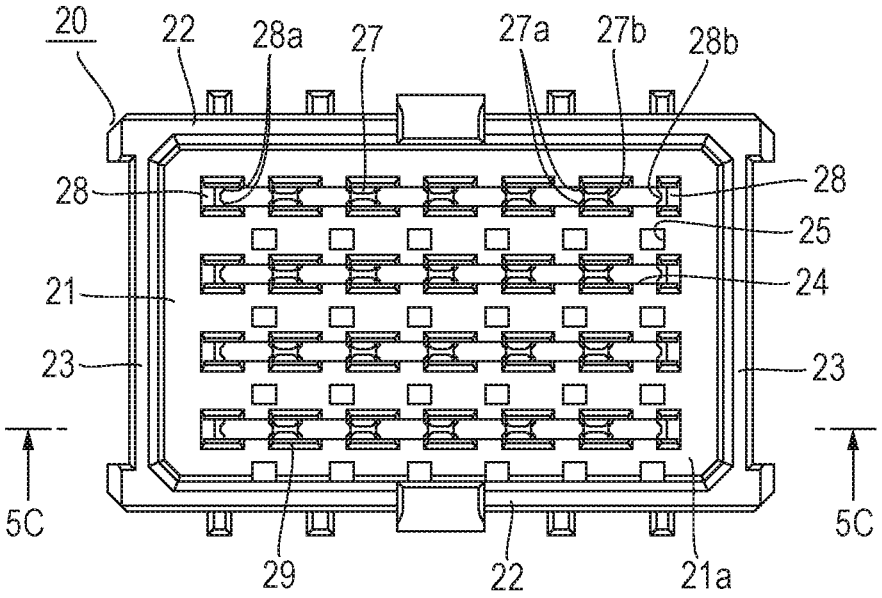
FIG. 5A is a plan view illustrating the insulator of FIG. 4A.
Figure 5B:
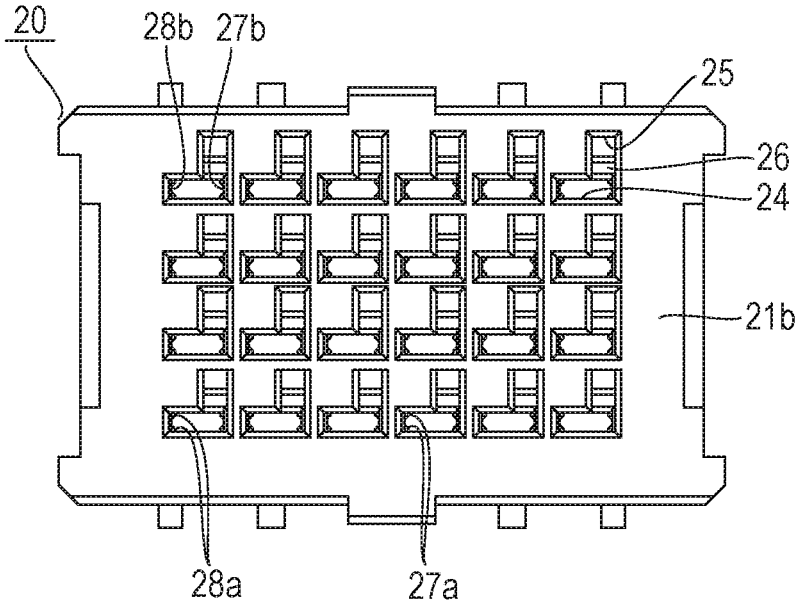
FIG. 5B is a bottom view illustrating the insulator of FIG. 5A.
Figure 5C:
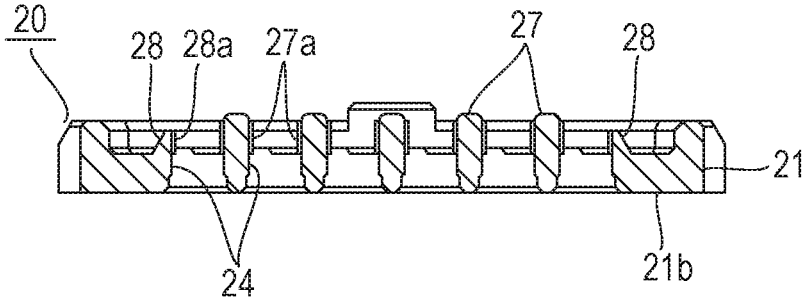
FIG. 5C is a sectional view taken along the 5C-5C line of FIG. 5A.

On the bottom plate portion 21, 24 through holes 24 are formed to be arranged in a lattice in which six through holes are aligned in the long side direction and four through holes are aligned in the short side direction. Hereinafter, the direction in which six through holes 24 are aligned is referred to as an alignment direction and the direction in which four through holes 24 are aligned is referred to as an inter-row direction. The through hole 24 is a rectangular hole elongated in the alignment direction and is formed to have a portion slightly wider (longer) in the alignment direction on the lower surface 21*b* side of the bottom plate portion 21 as illustrated in FIG. 5C.

On the bottom plate portion 21, 24 through holes 25 are further formed to be arranged in a lattice in which six through holes are aligned in the alignment direction and four through holes are aligned in the inter-row direction as is the case with the through holes 24. The through holes 25 are paired with the through holes 24 respectively and the through hole 25 is formed on a position, which is shifted from the through hole 24 in the inter-row direction, on one end side in the alignment direction of the through hole 24. The through hole 25 is a rectangular hole and a concave portion 26 that communicates the through hole 24 and the through hole 25 is formed between the through hole 24 and the through hole 25, which are paired, on the lower surface 21*b* of the bottom plate portion 21.

A protrusion 27 is formed between each two through holes 24, which are adjacent to each other in the alignment direction, in a state that the protrusion 27 stands up to the orthogonally-upper side from the upper surface 21*a*, which is an inner bottom surface of the insulator 20, of the bottom plate portion 21. Further, protrusions 28 are also respectively formed on the outer sides in the alignment direction of the through holes 24, which are positioned on both ends in the alignment direction, in a state that the protrusions 28 stand up to the upper side from the upper surface 21*a* of the bottom plate portion 21. Hereinafter, the standing direction (the orthogonally-upper direction) of the protrusion 27 with respect to the upper surface 21*a* of the bottom plate portion 21 is referred to as a mating direction.

The protrusion 27 is formed to stand up from the whole region, which is between the adjacent through holes 24, of the upper surface 21*a* of the bottom plate portion 21. On lateral surfaces, on both sides facing the alignment direction, of the protrusion 27, two projecting strips 27*a* are formed to be extended in the mating direction. The projecting strips 27*a* are each projected to the through hole 24. These two projecting strips 27*a* are positioned on both ends in the inter-row direction on the lateral surfaces of the protrusion 27 and these projecting strips 27*a* form a groove 27*b*, which extends in the mating direction and has a trapezoidal section, on each of the lateral surfaces of both sides of the protrusion 27.

Further, two projecting strips 28*a* are formed also on lateral surface on a side, which faces the alignment direction and on which the through hole 24 is positioned, of the protrusion 28 so that the projecting strips 28*a* is projected to the through hole 24, as is the case with the protrusion 27. These projecting strips 28*a* form a groove 28*b* which extends in the mating direction and has a trapezoidal section. Here, the protrusion 28 is formed to be slightly lower than the protrusion 27 and the lateral surface on a side, which faces the alignment direction and on which the through hole 24 is not formed, is formed to be an inclined surface.

On both sides in the inter-row direction of the protrusions 27 and 28 which are aligned and positioned in the alignment direction, reinforcement portions 29 are formed on the upper surface 21*a* of the bottom plate portion 21. The reinforcement portions 29 are coupled with base end portions of the protrusions 27 and 28 while sandwiching the base end portions and have a rib-like shape. Accordingly, the protrusions 27 and 28 stand up from the upper surface 21*a* of the bottom plate portion 21 are reinforced by the reinforcement portions 29. Though the reinforcement portion 29 is formed from the protrusion 28 positioned on one end side in the alignment direction to the protrusion 28 positioned on the other end side, the reinforcement portion 29 is partially cut out on a part on which each through hole 24 is positioned. In this example, the reinforcement portion 29 is cut out on one half portion (right half portion), in the alignment direction, of the through hole 24 as illustrated in FIG. 5A.

A convex portion 31 is formed on each center portion, in the alignment direction, of a pair of lateral walls 22 positioned on the long side portions of the bottom plate portion 21. The convex portion 31 protrudes to the outer surface side and protrudes in the mating direction. Further, a pair of convex portions 32 is each formed on both portions interposing the convex portion 31 in the alignment direction, on the pair of lateral walls 22 so that the convex portions 32 protrude to the outer surface side.

On the other hand, convex portions 33 protruding to the outer surface side are respectively formed on both end portions, in the inter-row direction, of a pair of lateral walls 23 positioned on the short side portions of the bottom plate portion 21.

Figure 6A:
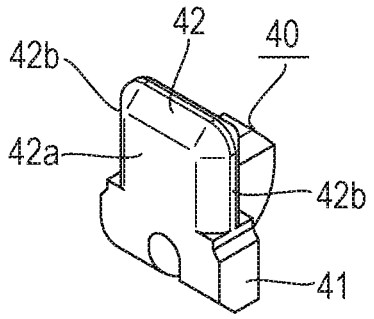
FIG. 6A is a perspective view illustrating a pin contact of FIG. 2A.
Figure 6B:
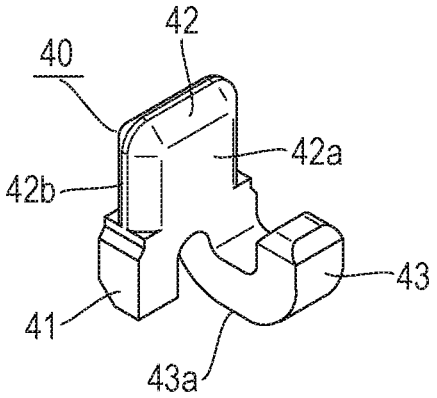
FIG. 6B is a perspective view illustrating the pin contact of FIG. 6A viewed from the opposite side.

The pin contact 40 is formed to have a shape illustrated in FIGS. 6A and 6B. The pin contact 40 is composed of a fixing portion 41 having a fork shape, a contact tab 42 standing up from the fixing portion 41, and a bent portion 43 which is formed by bending one leg portion of the fixing portion 41 and bending back the end of the leg portion to the standing direction (mating direction) of the contact tab 42.

The contact tab 42 is formed to have a plate shape and a pair of planar surfaces of the contact tab 42 on two mutually opposite sides thereof which are parallel to each other form contact surfaces 42*a* which are brought into contact with a mating socket contact. The lateral surfaces on both sides in the width direction of the contact tab 42 and the end surface (upper surface) of the contact tab 42 are chamfered and accordingly, projecting strips 42*b* having a trapezoidal section are respectively formed on the lateral surfaces of the contact tab 42 to be extended in the mating direction. Here, an intermediate portion of the bent portion 43 is a connection portion 43*a* which is to be connected with an electrode pad of a board on which the plug 100 is to be mounted.

The pin contact 40 is made of Cu alloy, for example, and Au plating is applied on the surface thereof.

The metal fitting 50 is formed to have a shape illustrated in FIGS. 8A to 8D, that is, the metal fitting 50 has a U shape as a whole, Each of both leg portions 51 of the U shape is composed of an upper plate portion 51*a* which is to be put on the upper surface of the lateral wall 22 of the insulator 20 and lateral plate portion 51*b* which is to be positioned along the outer surface side of the lateral wall 22. On a lower end of a center portion, in the longitudinal direction, of the lateral plate portion 51*b*, a fixing piece 52 is formed so that the fixing piece 52 is bent and extended outward from the lateral plate portion 51*b*. Here, cutouts 53 are formed on both sides of a part, on which the fixing piece 52 is positioned, of the lateral plate portion 51*b*, and a protrusion 54 protruding to the cutout 53 is formed on a part, which is close to the end of the leg portion 51, of the lateral plate portion 51*b*.

Further, an intermediate portion 55 of the U shape of the metal fitting 50 is composed of an upper plate portion 55*a* which is to be put on the upper surface of the lateral wall 23 of the insulator 20 and a lateral plate portion 55*b* which is to be positioned along the outer surface side of the lateral wall 23. The lateral plate portion 55*b* is separated from adjacent lateral plate portions 51*h*. Protrusions 56, which mutually protrude outward, are formed respectively on both end surfaces in the longitudinal direction of the lateral plate portion 55*b* and a fixing piece 57 is formed on a lower end of a center portion, in the longitudinal direction, of the lateral plate portion 55*b* so that the fixing piece 57 is bent and extended outward from the lateral plate portion 55*b*.

Assembly of the plug 100 illustrated in FIGS. 2A and 2B and FIGS. 3A to 31) is now described.

Figure 3C:
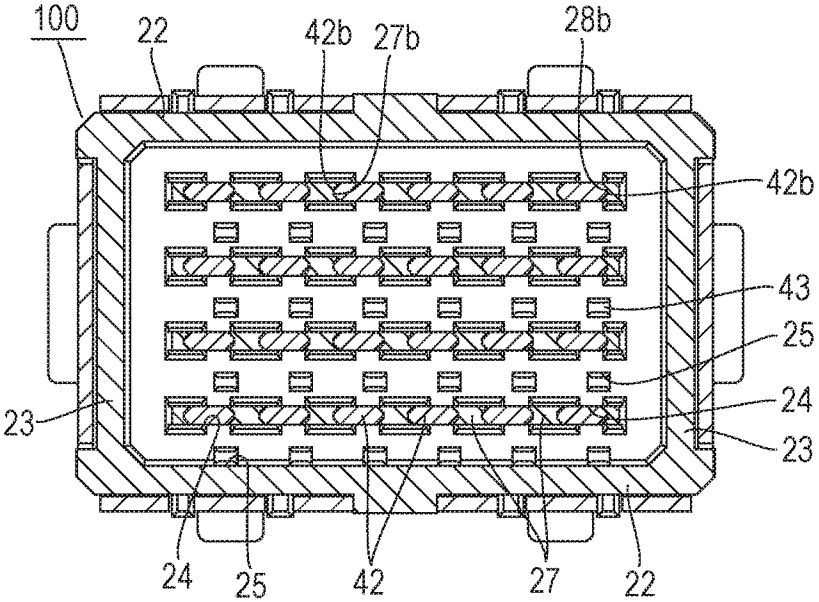
FIG. 3C is a sectional view taken along the 3C-3C line of FIG. 3B.
Figure 3D:
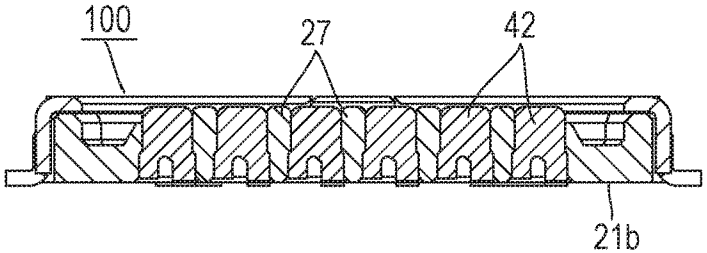
FIG. 3D is a sectional view taken along the 3D-3D line of FIG. 3A.
Figure 3A:
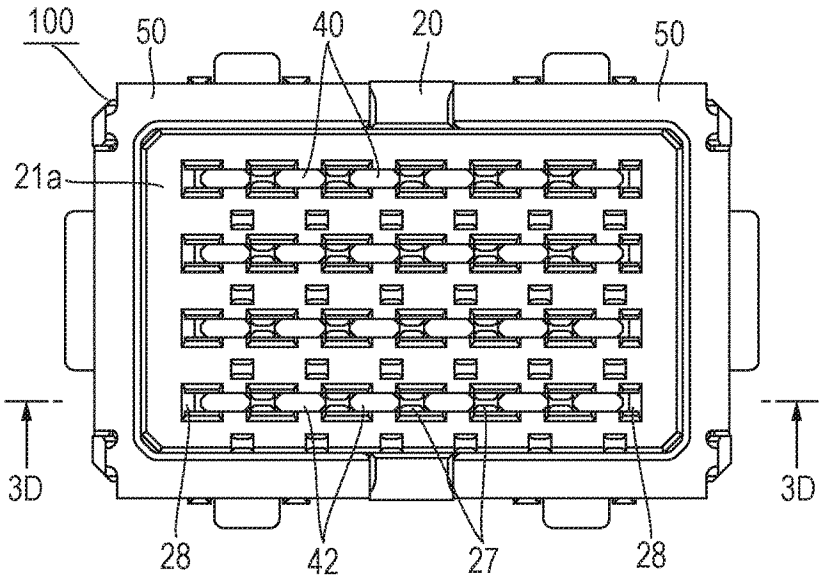
FIG. 3A is a plan view illustrating the plug of FIG. 2A.
Figure 3B:
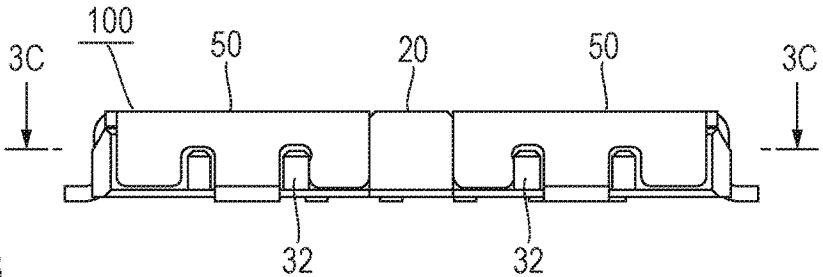
FIG. 3B is a front elevational view illustrating the plug of FIG. 3A.
Figure 4A:
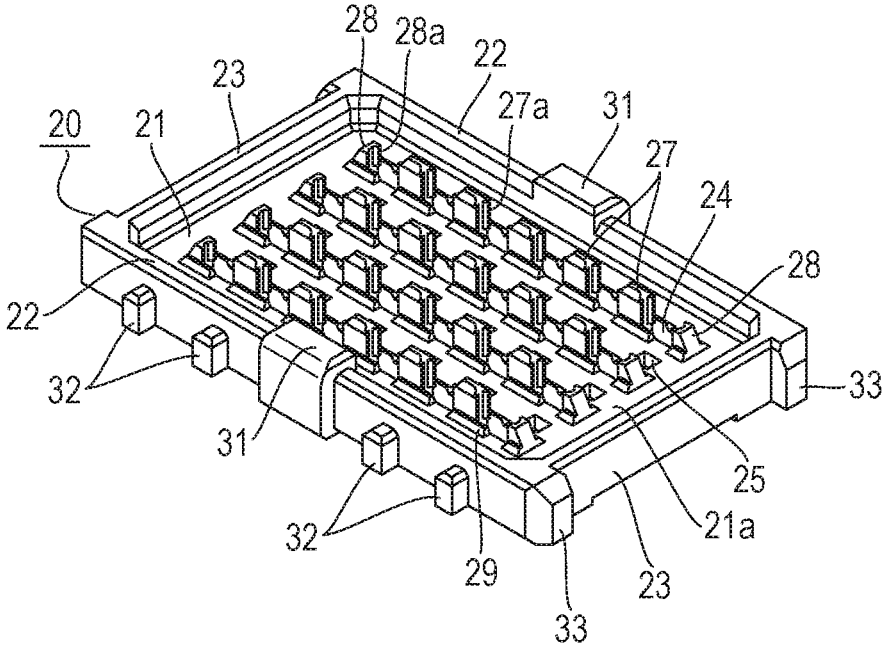
FIG. 4A is a perspective view illustrating an insulator of FIG. 2A viewed from the upper side.
Figure 4B:
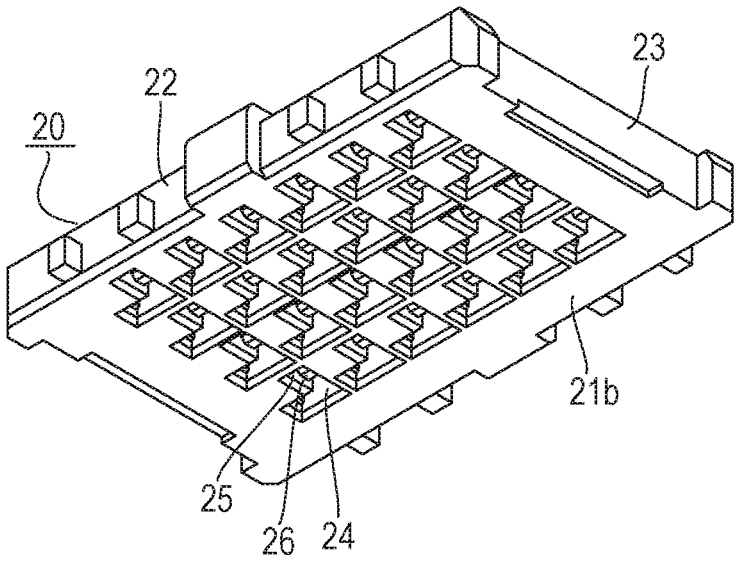
FIG. 4B is a perspective view illustrating the insulator of FIG. 4A viewed from the lower side.

The pin contact 40 is attached to the insulator 20 such that the contact tab 42 is inserted from the lower surface 21*b* of the bottom plate portion 21 into the through hole 24 on the bottom plate portion 21 of the insulator 20 and then the fixing portion 41 is press-fitted, as illustrated in FIG. 3D. In this case, the bent portion 43 of the pin contact 40 is housed in the concave portion 26 on the lower surface 21*b* of the bottom plate portion 21 and the end of the bent portion 43 is fitted into the through hole 25 of the bottom plate portion 21. The connection portion 43*a*, which is an intermediate portion, of the bent portion 43 is exposed on the lower surface. 21*b* of the bottom plate portion 21.

The contact tab 42 of the pin contact 40 is protruded from the upper surface 21*a* of the bottom plate portion 21 and stand up in the mating direction. Each of the protrusions 27 is positioned between two of the contact tabs 42 which are next to each other in the alignment direction. The projecting strip 42*b*, which is formed on the lateral surface faced the alignment direction and opposed to the lateral surface of the protrusion 27 in the alignment direction, of the contact tab 42 is fitted into the groove 27*b* of the protrusion 27. Here, the projecting strips 42*b*, which are positioned on the outer sides in the alignment direction, of the contact tabs 42 positioned on both ends in the alignment direction are fitted into the grooves 28*b* of the protrusions 28.

Thus attached, the pin contacts 40 are aligned so that the contact surfaces 42*a* are parallel to the alignment direction. Since the protrusion 27 is each positioned between the contact tabs 42 which are next to each other in the alignment direction, a gap between the contact tabs 42 which are next to each other in the alignment direction is closed by the protrusion 27. In this example, the thickness, in the inter-row direction, of the protrusions 27 and 28 is set to be equal to the thickness of the contact tab 42, so that each pair of planar surfaces of the protrusions 27 and 28 on two mutually opposite sides thereof which are parallel to each other are respectively flush with the contact surfaces 42*a* on both sides of the contact tab 42 adjacent to the protrusions 27 and 28.

Figure 2A:
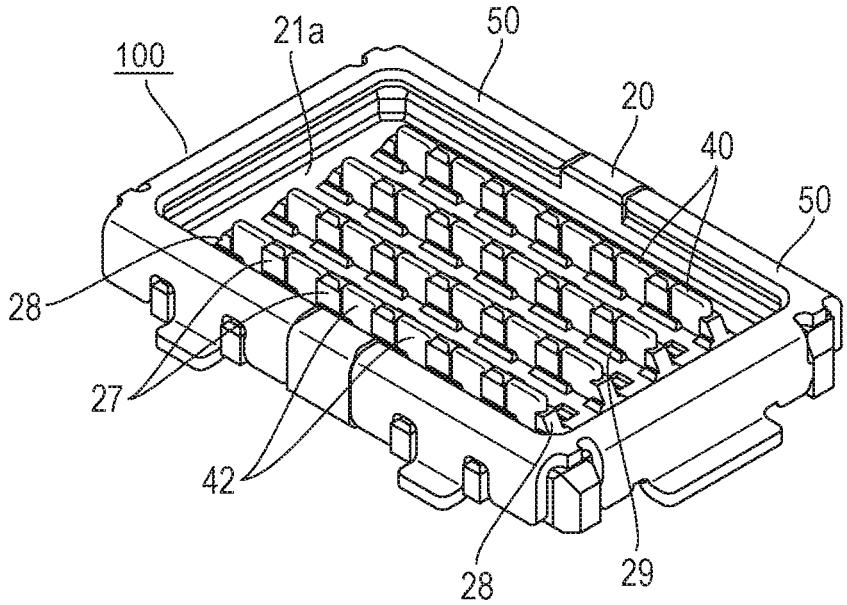
FIG. 2A is a perspective view illustrating an embodiment of a plug according to the present invention viewed from the upper side.
Figure 2B:
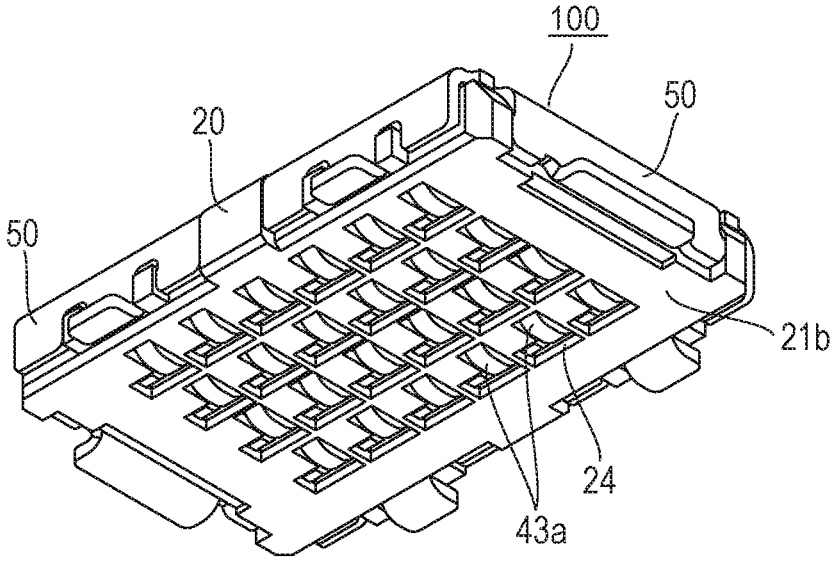
FIG. 2B is a perspective view illustrating the plug of FIG. 2A viewed from the lower side.

The pair of metal fittings 50 is fitted to the lateral walls 22 and 23 of the insulator 20 from the upper side to be attached to the insulator 20 as illustrated in FIGS. 2A and 2B. The pair of protrusions 56 formed on the lateral plate portion 55*b* is engaged with the convex portions 33, which are formed on the lateral wall 23, and locked, and the protrusions 54 formed on the lateral plate portions 51*b* are engaged with the convex portions 32, which are formed on the lateral walls 22, and locked. Thus, the metal fittings 50 are solidly fixed on the insulator 20. The fixing pieces 52 and 57 of the metal fitting 50 are positioned on the lower surface 21*b* side of the bottom plate portion 21 of the insulator 20.

In the plug 100 configured as described above, the protrusion 27 of the insulator 20 is positioned between the contact tabs 42 of the pin contacts 40 which are next to each other in the alignment direction and thus there is no gap between the contact tabs 42. Accordingly, a part of a socket contact and a corner portion of a receptacle insulator, for example, of a receptacle are not fitted between the contact tabs 42 in a mating operation with respect to the receptacle. As a result, deformation and damages of the pin contacts 40 and socket contacts can be prevented and favorable mating operability can be obtained.

This example employs the configuration that the projecting strips 42*b* are formed on the lateral surfaces, which face the alignment direction, of the contact tabs 42 of the pin contacts 40 and the projecting strips 42*b* are fitted into the grooves 27*b* and 28*b* of the protrusions 27 and 28 of the insulator 20, so that the standing state of the contact tabs 42 is solidly maintained by the insulator 20. The projecting strip 42*b* has the trapezoidal section in this example, but the projecting strip 42*b* may have a triangular section or a convex section. On the protrusions 27 and 28 of the insulator 20, grooves corresponding to the shape of the projecting strip 42*b* of the contact tab 42 are formed.

Figure 7A:
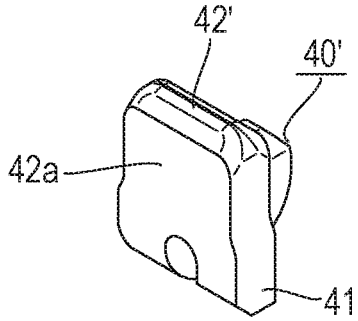
FIG. 7A is a perspective view illustrating another shape example of the pin contact.
Figure 7B:
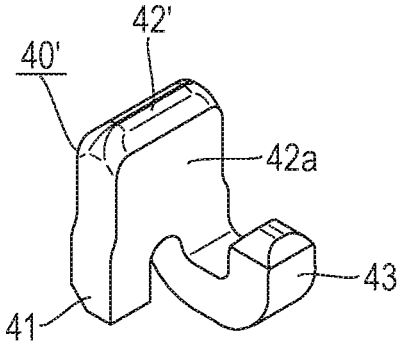
FIG. 7B is a perspective view illustrating the pin contact of FIG. 7A viewed from the opposite side.
Figure 8C:
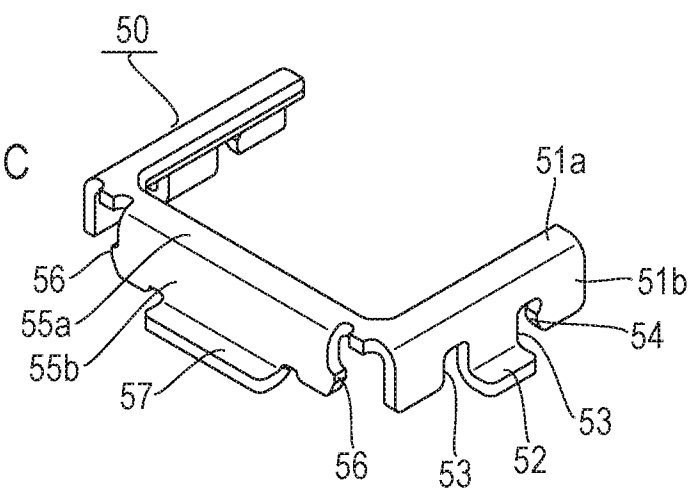
FIG. 8C is a perspective view illustrating the metal fitting of FIG. 8A viewed from the rear side.
Figure 8D:
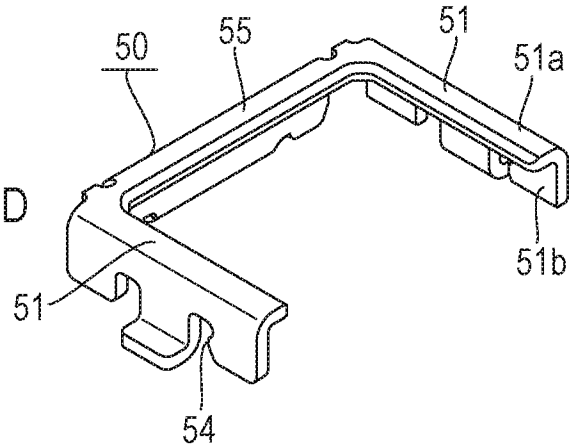
FIG. 8D is a perspective view illustrating the metal fitting of FIG. 8A viewed from the front side.
Figure 8A:
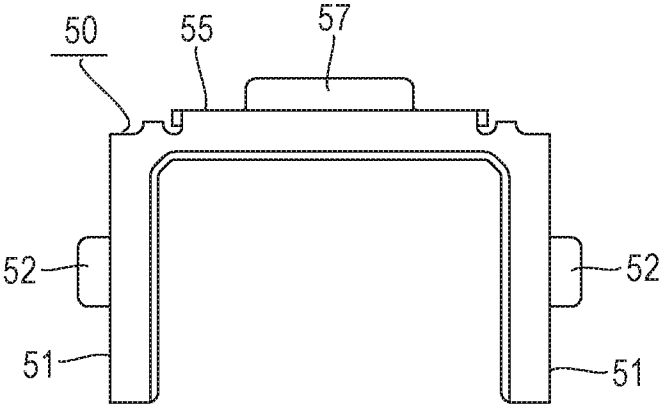
FIG. 8A is a plan view illustrating a metal fitting of FIG. 2A.
Figure 8B:
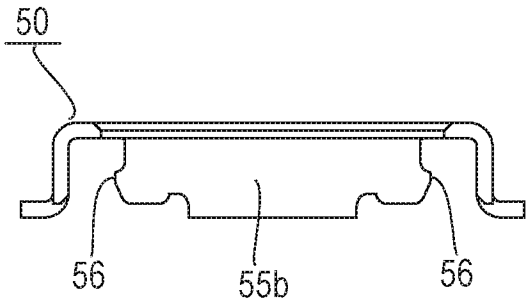
FIG. 8B is a front elevational view illustrating the metal fitting of FIG. 8A.

On the other hand, the configuration that a projecting strip is not formed on a contact tab of a pin contact may be employed so as to simplify shapes of a pin contact and an insulator. FIGS. 7A and 7B illustrate a shape of a pin contact 40' having a contact tab 42' in which a projecting strip is not formed on lateral surfaces facing the alignment direction.

Though the pin contacts 40 are press-fitted and arranged in the insulator 20 in the above-described example, the pin contacts can be arranged in the insulator by insert molding, for example, instead of press-fitting.

The configuration of a receptacle according to the present invention that mate with the plug 100 described above is now described.

FIGS. 9A and 9B and FIGS. 10A to 10C illustrate a receptacle according to an embodiment of the present invention. This receptacle 200 is composed of a receptacle insulator 60 constituting a housing, 24 socket contacts 80 which are housed in the receptacle insulator 60 and are arranged and held in a lattice, and a pair of metal fittings 90 attached on a periphery of the receptacle insulator 60, in this example. Hereinafter, in 24 socket contacts 80 arranged in a lattice, the direction in which six socket contacts 80 are aligned is referred to as a socket alignment direction and the direction in which four socket contacts 80 are aligned is referred to as a socket inter-row direction. The configuration of each component is first described.

The receptacle insulator 60 is made of heat resistant resin such as liquid crystal polymer as is the case with the insulator 20. In this example, the insulator 60 has a bottom plate portion 61 having a shape obtained by cutting out corner portions of a rectangle and lateral walls are formed on a peripheral edge of the bottom plate portion 61, as illustrated in FIGS. 11A and 11B and FIGS. 12A to 12C, The lateral walls are a pair of lateral walls 62 positioned on long side portions of the bottom plate portion 61 and a pair of lateral walls 63 positioned on short side portions of the bottom plate portion 61.

The bottom plate portion 61 has a pedestal shaped portion 64 which protrudes to the mating direction with respect to the plug 100 and four grooves 65 which extend in the socket alignment direction of the socket contacts 80 are formed on an upper surface 64*a* of the pedestal shaped portion 64. Further on the pedestal shaped portion 64, 24 through holes 66 are formed to be arranged in a lattice, in which six through holes 66 are aligned in the socket alignment direction and four through holes 66 are aligned in the socket inter-row direction, from the upper surface 64*a* of the pedestal shaped portion 64 to a lower surface 61*a* of the bottom plate portion 61. Each of the six through holes 66 aligned in the socket alignment direction is positioned across the groove 65. Accordingly, six pairs of concave portions 67, which are opposed to each other, are formed on mutually-opposed wall surfaces (inner wall surfaces) along the extending direction (socket alignment direction) of the groove 65.

On the lower surface 61*a* of the bottom plate portion 61, concave portions 68, which communicate with the through holes 66 in the socket alignment direction, are formed to be paired with respective through holes 66.

On each center portion of a pair of lateral walls 62, which are positioned on the long side portions of the bottom plate portion 61, a convex portion 69, which protrudes to the inner surface side and the outer surface side and also protrudes in the mating direction, is formed. Further, convex portions 71 which protrude to the inner surface side and to the mating direction are formed on portions, interposing the convex portion 69 in the socket alignment direction, of the lateral wall 62.

On the other hand, on each center portion of a pair of lateral walls 63, which are positioned on the short side portions of the bottom plate portion 61, a convex portion 72, which protrudes to the inner surface side and to the mating direction, is formed. Further, corner frames 73 are formed to protrude outward on outer surfaces of four corner portions which are formed by the lateral walls 62 and the lateral walls 63.

Figure 13A:
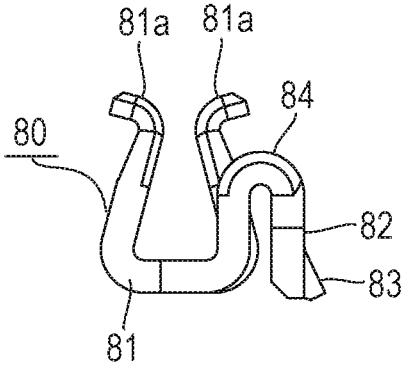
FIG. 13A is a front elevational view illustrating a socket contact of FIG. 9A.
Figure 13B:
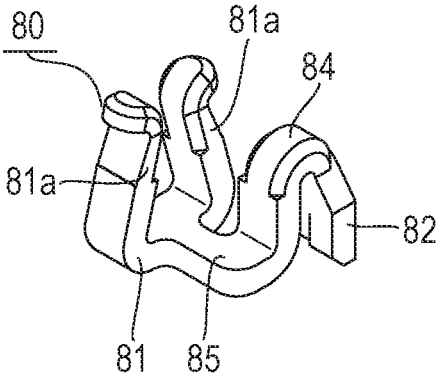
FIG. 13B is a perspective view illustrating the socket contact of FIG. 13A.
Figure 13C:
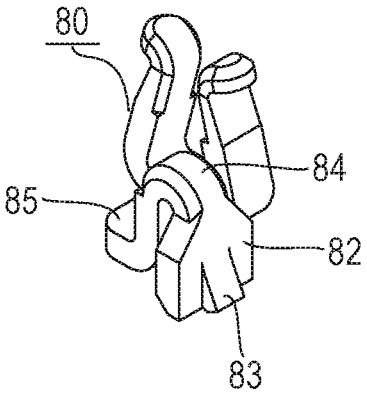
FIG. 13C is a perspective view illustrating the socket contact of FIG. 13B viewed from the opposite side.
Figure 14C:
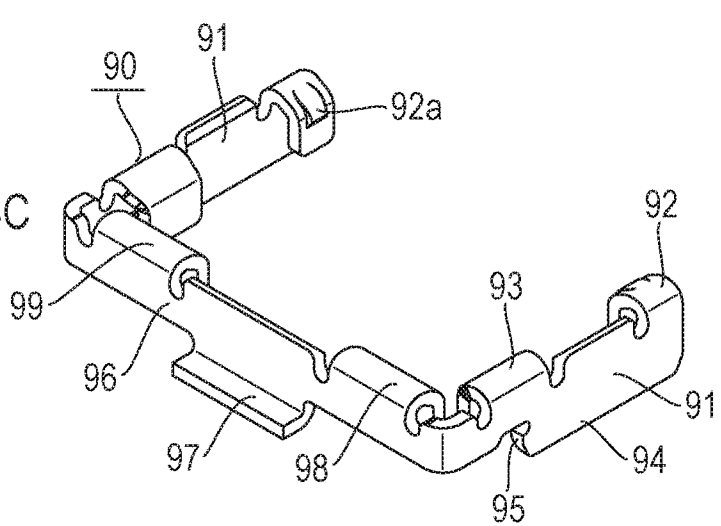
FIG. 14C is a perspective view illustrating the metal fitting of FIG. 14A viewed from the rear side.
Figure 14D:
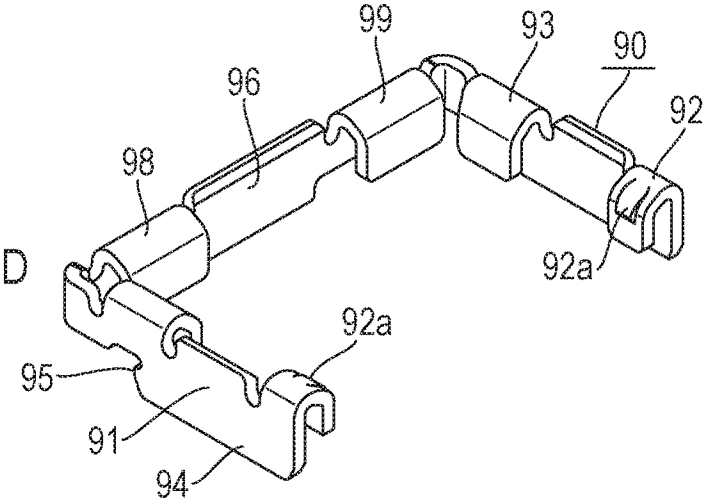
FIG. 14D is a perspective view illustrating the metal fitting of FIG. 14A viewed from the front side.
Figure 14A:
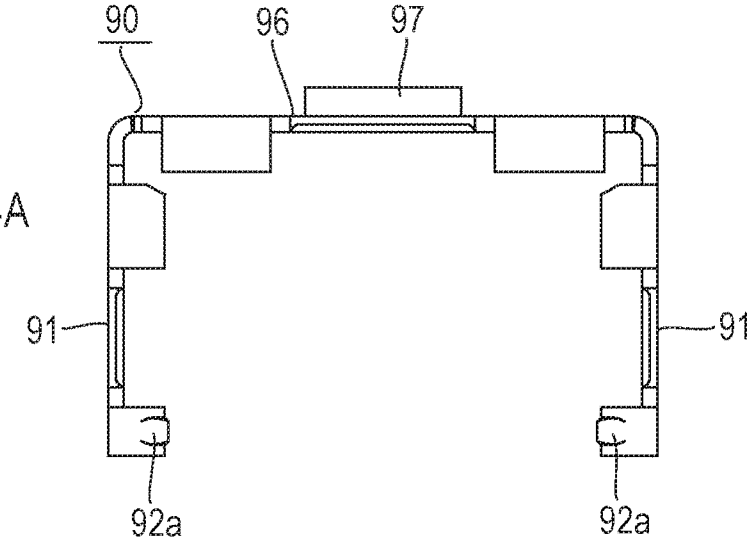
FIG. 14A is a plan view illustrating the metal fitting of FIG. 9A.
Figure 14B:
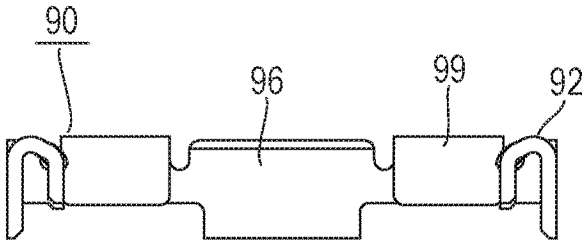
FIG. 14B is a front elevational view illustrating the metal fitting of FIG. 14A.

The socket contact 80 is formed to have a shape illustrated in FIGS. 13A to 13C. The socket contact 80 includes a contact portion 81, a fixing portion 82, a connection portion 83, a spring portion 84, and a coupling portion 85. The contact portion 81 includes a pair of contact pieces 81*a* which are opposed to each other and can be elastically displaced respectively to the opposing direction.

The pair of contact pieces 81*a* comes into contact with the contact tab 42 of the pin contact 40 at two points while sandwiching the contact tab 42. Ends of the contact pieces 81*a* are bent outward mutually. The fixing portion 82 is a portion which is fixed and held on the bottom plate portion 61 of the receptacle insulator 60. The connection portion 83 which is connected with an electrode pad of a board on which the receptacle 200 is to be mounted is formed such that a center portion on the lower end side of the fixing portion 82 is cut and raised and thus connected with the fixing portion 82.

The spring portion 84 has the U shape and one end thereof is connected with the fixing portion 82. The coupling portion 85 connects the other end of the spring portion 84 and the contact portion 81, and the spring portion 84 has a function to render the contact portion 81 displaceable in the direction parallel to the opposing direction of the pair of contact pieces 81*a*, with respect to the fixing portion 82.

The spring portion 84 and the pair of contact pieces 81*a* are configured to protrude to the same side in the mating direction with the plug 100, with respect to the coupling portion 85, and are positioned to be shifted from each other in the socket alignment direction of the socket contacts 80. Further, the spring portion 84 and the pair of contact pieces 81*a* are positioned to be shifted from each other in the direction parallel to the opposing direction of the pair of contact pieces 81*a* as well.

The socket contact 80 is made of Cu alloy, for example, and Au plating is applied on the surface thereof, as is the case with the pin contact 40.

The metal fitting 90 is formed to have a shape illustrated in FIGS. 14A to 14D, that is, the metal fitting 90 has a U shape as a whole. Each of both leg portions of the U shape is composed of a lateral plate 91 which is to be positioned along the outer surface side of the lateral wall 62 of the receptacle insulator 60, On two portions excluding the center portion in the longitudinal direction of the lateral plate 91, bent pieces 92 and 93 are formed in an inwardly-bent shape. On the bent piece 92 positioned closer to the end of the lateral plate 91 in the longitudinal direction, a protruding portion 92*a* is formed to protrude inward, Here, an extension piece 94 is formed on the lower end of the lateral plate 91 and a protrusion 95 is formed on the end surface of the extension piece 94.

The intermediate portion of the U shape of the metal fitting 90 is composed of a lateral plate 96 which is to be positioned along the outer surface side of the lateral wall 63 of the receptacle insulator 60. On the lower end in the center portion in the longitudinal direction of the lateral plate 96, a fixing piece 97 is formed so that the fixing piece 97 is bent and extended outward from the lateral plate 96. Further, bent pieces 98 and 99 are formed in an inwardly-bent manner on both sides of the portion, on which the fixing piece 97 is formed, in the longitudinal direction of the lateral plate 96.

Assembly of the receptacle 200 illustrated in FIGS. 9A and 9B and FIGS. 10A to 10C is now described.

Figure 9A:
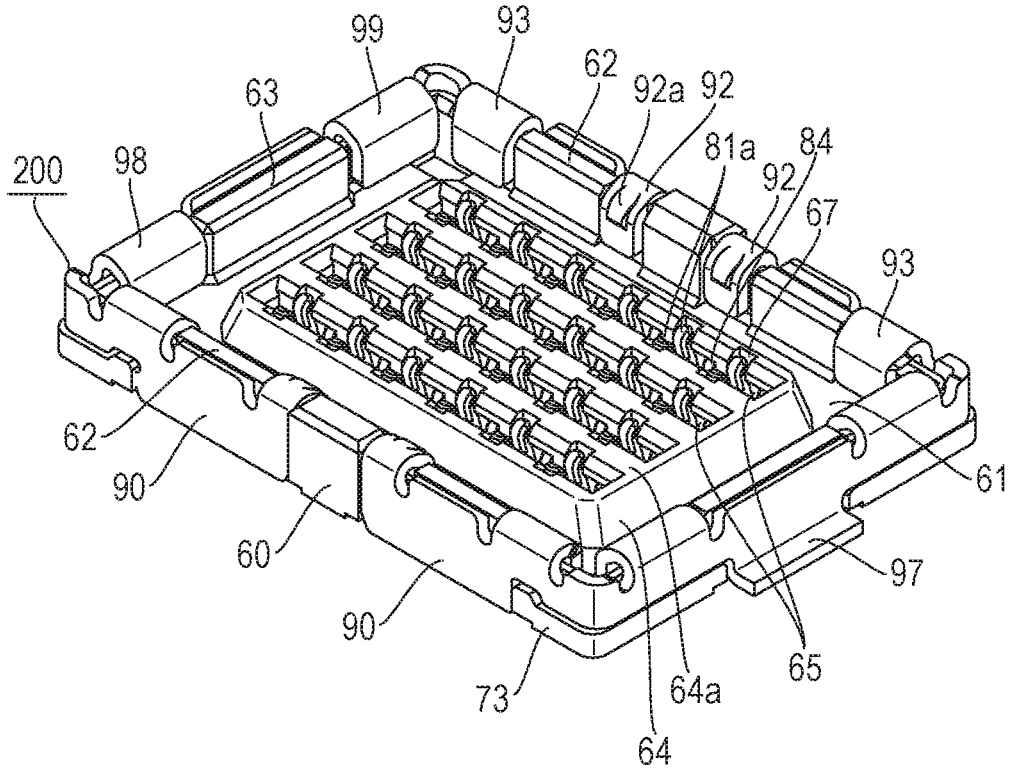
FIG. 9A is a perspective view illustrating an embodiment of a receptacle according to the present invention viewed from the upper side.
Figure 10A:
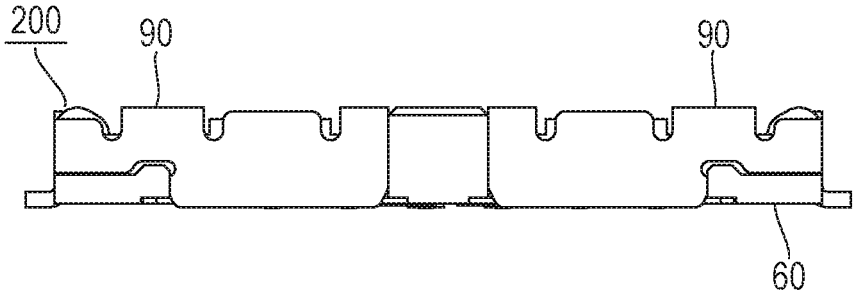
FIG. 10A is a front elevational view illustrating the receptacle of FIG. 9A.
Figure 10B:
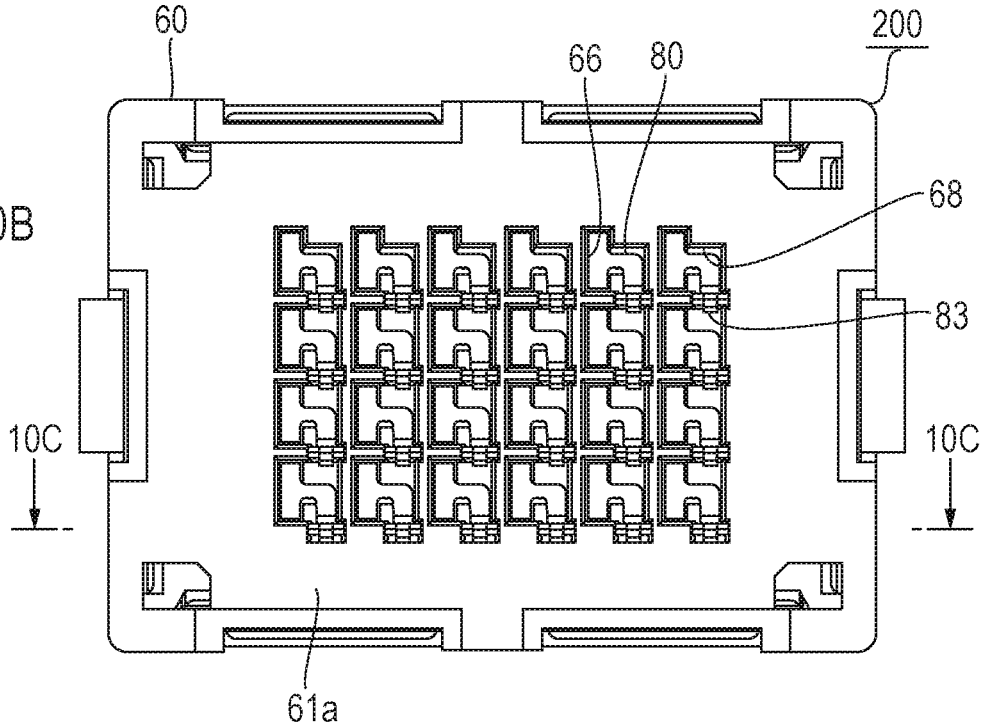
FIG. 10B is a bottom view illustrating the receptacle of FIG. 1.0A.
Figure 10C:
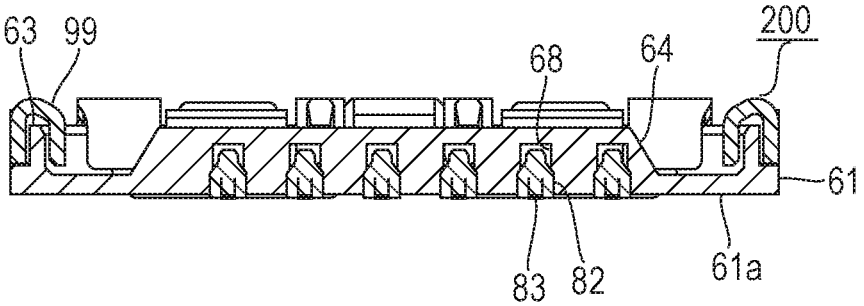
FIG. 10C is a sectional view taken along the 10C-10C line of FIG. 10B.
Figure 11A:
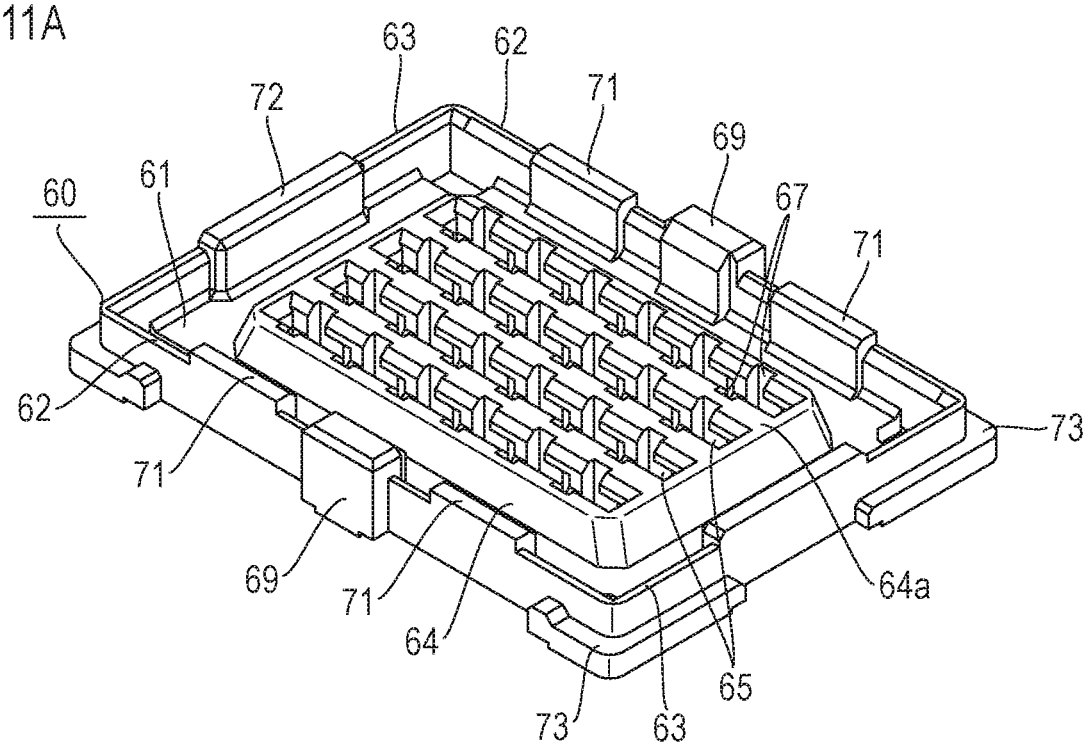
FIG. 11A is a perspective view illustrating a receptacle insulator of FIG. 9A viewed from the upper side.
Figure 11B:
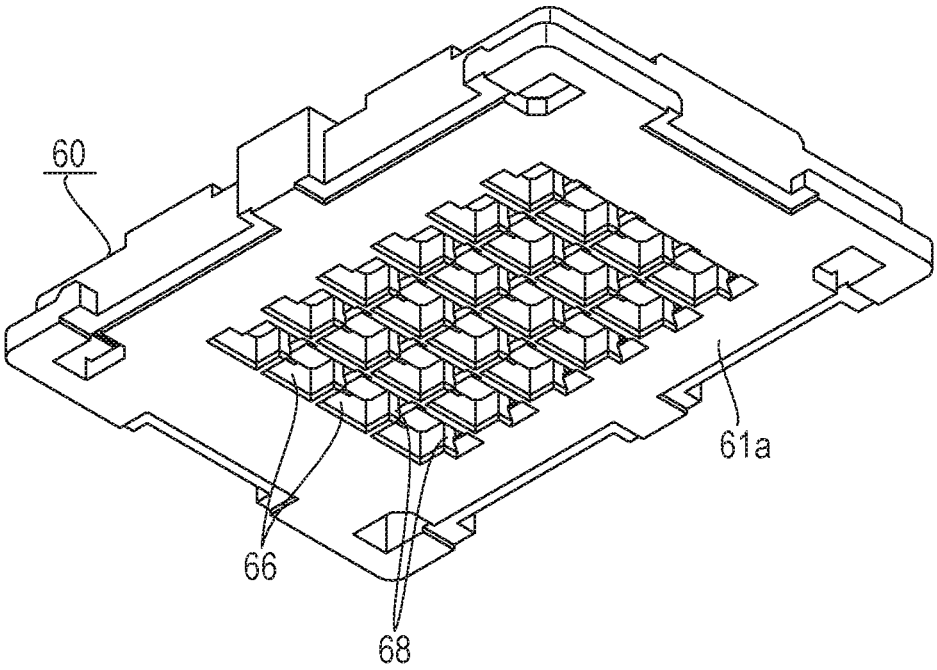
FIG. 11B is a perspective view illustrating the receptacle insulator of FIG. 11A viewed from the lower side.
Figure 12A:
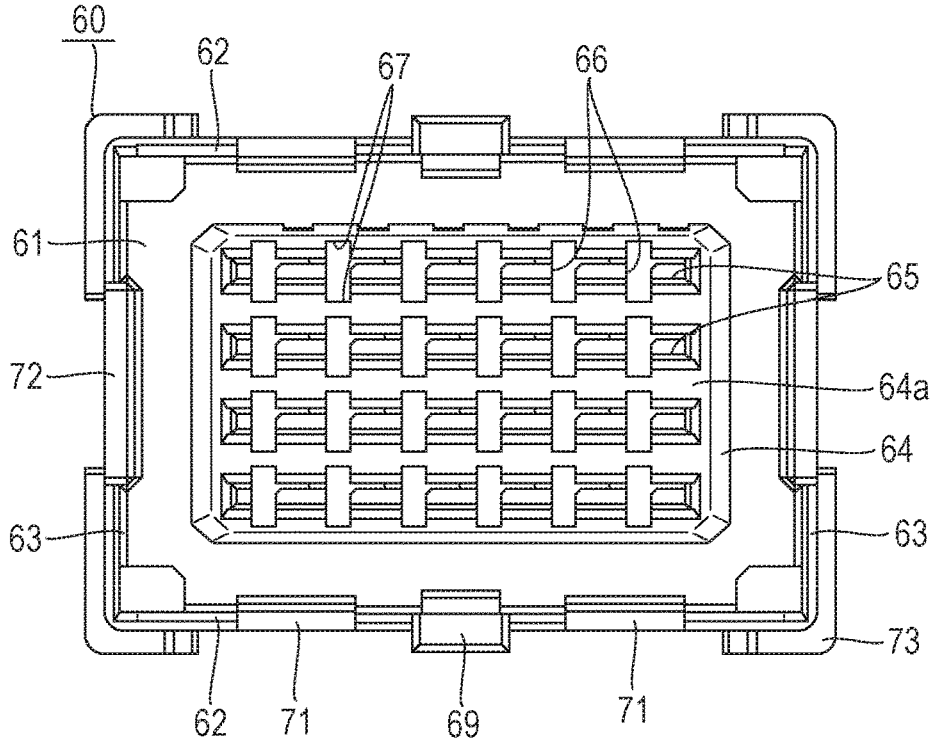
FIG. 12A is a plan view illustrating the receptacle insulator of FIG. 11A.
Figure 12B:
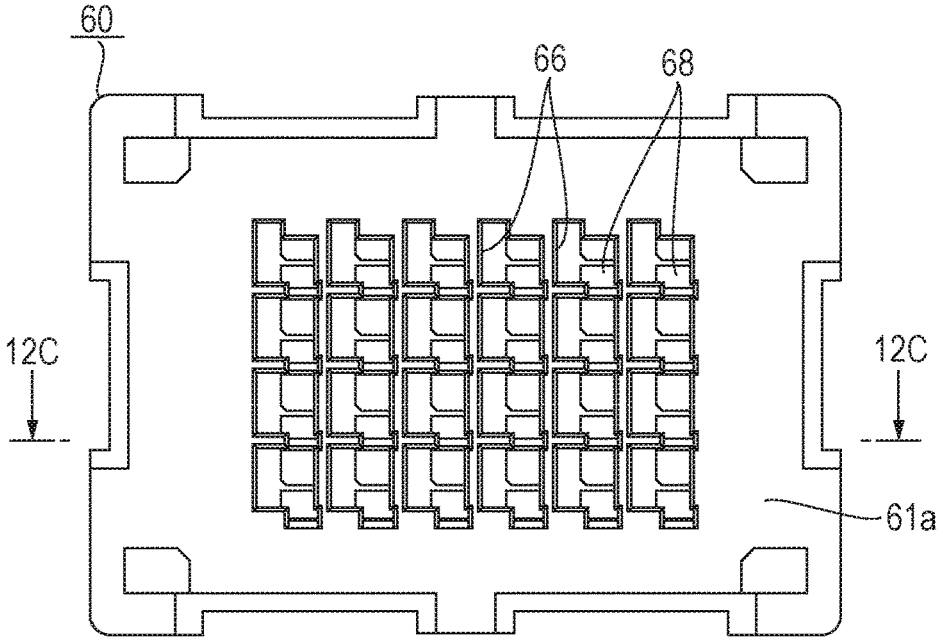
FIG. 12B is a bottom view illustrating the receptacle insulator of FIG. 12A.
Figure 12C:
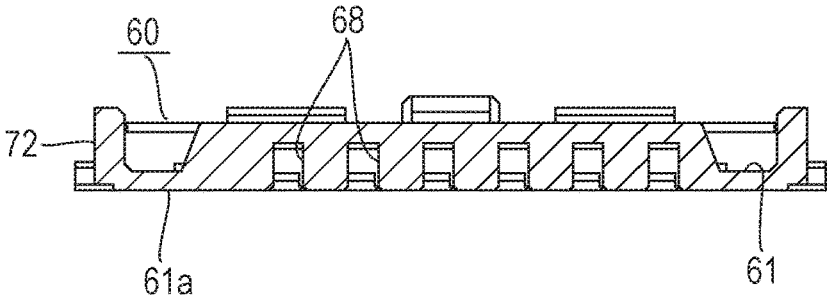
FIG. 12C is a sectional view taken along the 12C-12C line of FIG. 12B.

The socket contact 80 is attached to the receptacle insulator 60 such that the contact portion 81 is inserted from the lower surface 61*a* of the bottom plate portion 61 into the through hole 66 on the bottom plate portion 61 of the receptacle insulator 60 and then the fixing portion 82 is press-fitted to the concave portion 68 formed on the lower surface 61*a* of the bottom plate portion 61, as illustrated in FIG. 10B. The pair of contact pieces 81*a* of the contact portion 81 is positioned on the concave portions 67, which are formed on the wall surfaces of the groove 65 to be opposed to each other, as illustrated in FIG. 9A.

The spring portion 84 of the socket contact 80 is housed in the concave portion 68 and the connection portion 83 and the coupling portion 85 are exposed on the lower surface 61*a* of the bottom plate portion 61.

Figure 9B:
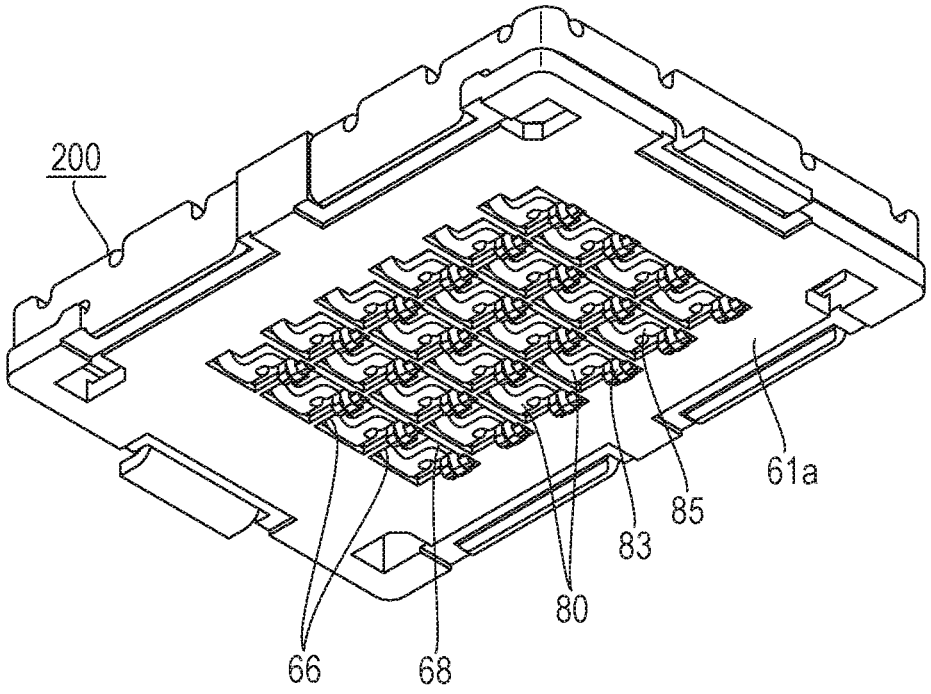
FIG. 9B is a perspective view illustrating the receptacle of FIG. 9A viewed from the lower side.

The pair of metal fittings 90 is fitted to the lateral walls 62 and 63 of the receptacle insulator 60 from the upper side to be attached to the insulator 60 as illustrated in FIGS. 9A and 9B. The protrusion 95 formed on the extension piece 94 of the lateral plate 91 is engaged with the corner frame 73, which is formed on a corner portion formed by the lateral walls 62 and 63, to be locked. Each of the bent pieces 92 and 93 pinches the lateral wall 62 and each of the bent pieces 98 and 99 pinches the lateral wall 63. The metal fittings 90 are thus attached to the receptacle insulator 60 and the fixing piece 97 of the metal fitting 90 is positioned on the lower surface 61*a* side of the bottom plate portion 61 of the receptacle insulator 60.

In the receptacle 200 configured as described above, four grooves 65 extending in the socket alignment direction are formed on the receptacle insulator 60 and the contact portions 81 of six socket contacts 80 are aligned in each of the grooves 65.

The socket contact 80 includes the spring portion 84 which renders the contact portion 81 displaceable in the direction parallel to the opposing direction of the pair of contact pieces 81*a*, as described above. Accordingly, even if positional accuracy, in the inter-row direction, of the contact tab 42 of the mating pin contact 40 which is inserted between the pair of contact pieces 81*a*, that is, positional accuracy in the direction in which contact force is applied is poor, the socket contact 80 can absorb displacement of the pin contact 40, preventing the contact force from varying. Thus, desired stable contact force can be obtained.

The spring portion 84 is formed to protrude to the same side as the pair of contact pieces 81*a* with respect to the coupling portion 85, and is positioned on a shifted position with respect to the pair of contact pieces 81*a* in the socket alignment direction. Through these points, even though the spring portion 84 is provided, the dimension of the receptacle 200 in the thickness of the mating direction and socket inter-row directions is not increased.

Figure 17A:
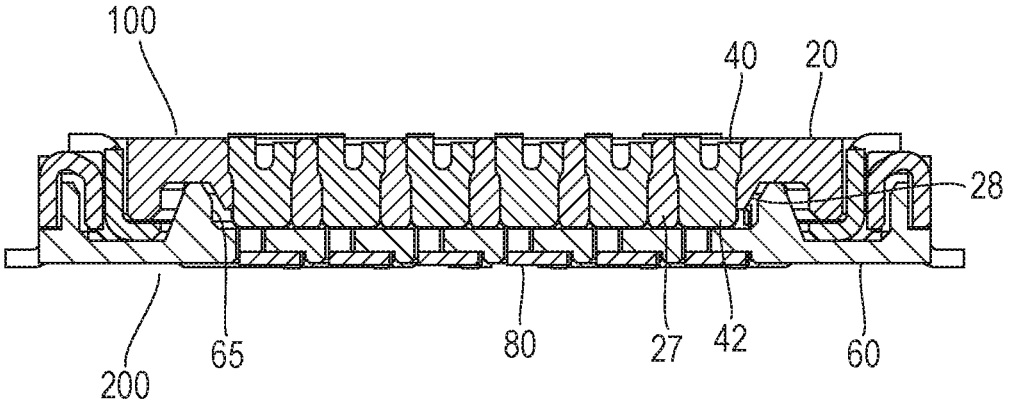
FIG. 17A is an enlarged sectional view taken along the 17A-17A line 6A.
Figure 17B:
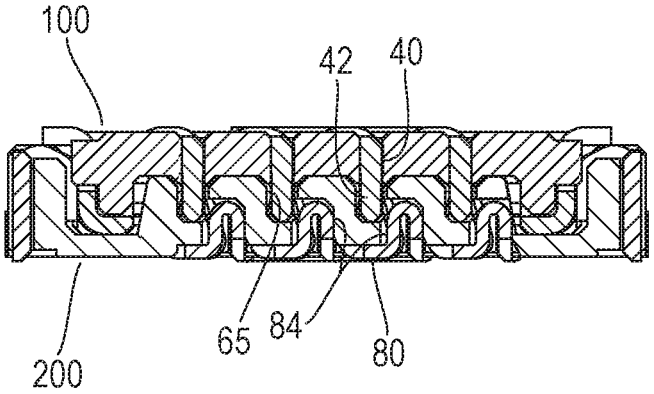
FIG. 17B is an enlarged sectional view taken along the 17B-17B line of FIG. 16B.

Further, the spring portion 84 is positioned on a shifted position with respect to the pair of contact pieces 81*a* in the direction parallel to the opposing direction, that is, the socket inter-row direction, of the pair of contact pieces 81*a* as well. Accordingly, the spring portion 84 is positioned on a position retreated from the groove 65 in the socket inter-row direction without providing a portion, to which the spring portion 84 protrudes, in the groove 65, as illustrated in FIG. 9A and FIG. 17B.

The plug 100 and the receptacle 200 described above constitute a board to board connector used for electrically connecting boards to each other. The plug 100 is mounted on a mounting surface of a board such that the connection portions 43*a* of the pin contacts 40 and the fixing pieces 52 and 57 of the metal fittings 50 are soldered on an electrode pad of the board. The receptacle 200 is mounted on a mounting surface of a mating board such that the connection portions 83 of the socket contacts 80 and the fixing pieces 97 of the metal fittings 90 are soldered on an electrode pad of the mating board. The bottom plate portion 21 of the insulator 20 of the plug 100 and the bottom plate portion 61 of the receptacle insulator 60 of the receptacle 200 are respectively mounted on the mounting surfaces of the boards.

Figure 15:
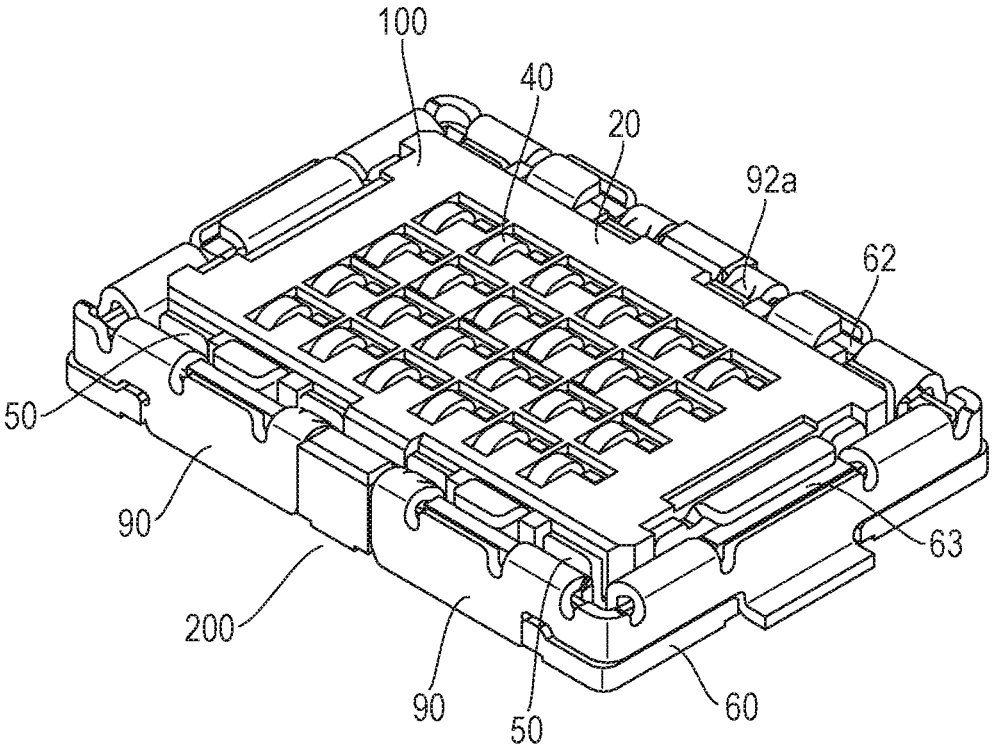
FIG. 15 is a perspective view illustrating a mating state of the plug of FIG. 2A and the receptacle of FIG. 9A.
Figure 16A:
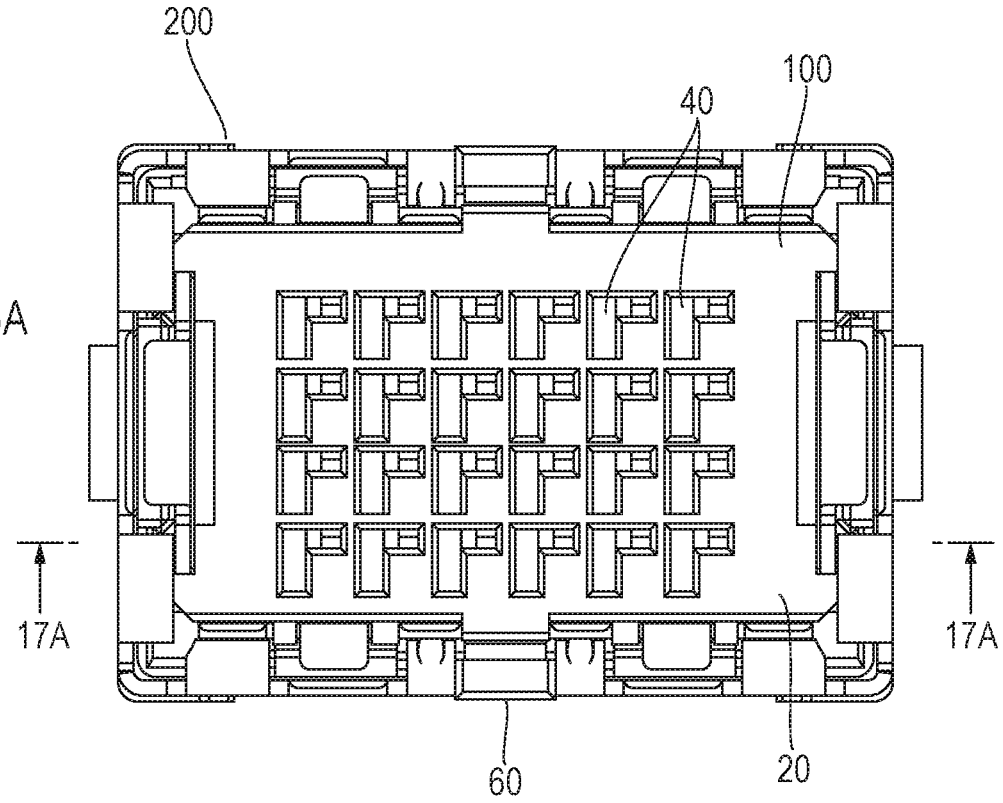
FIG. 16A is a plan view illustrating the mating state of the plug of FIG. 2A and the receptacle of FIG. 9A.
Figure 16B:
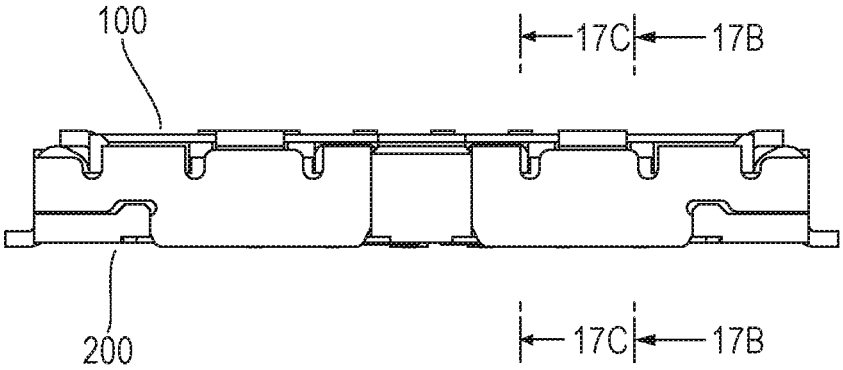
FIG. 16B is a front elevational view illustrating the mating state of FIG. 16A.

The plug 100 and the receptacle 200 are mated and connected with each other in the orthogonal direction to the mounting surface. FIG. 15 and FIGS. 16A and 16B illustrate a state that the plug 100 and the receptacle 200 are mated with each other while omitting illustration of the boards, and FIGS. 17A to 17C illustrate the sectional configuration of the state.

Figure 17C:
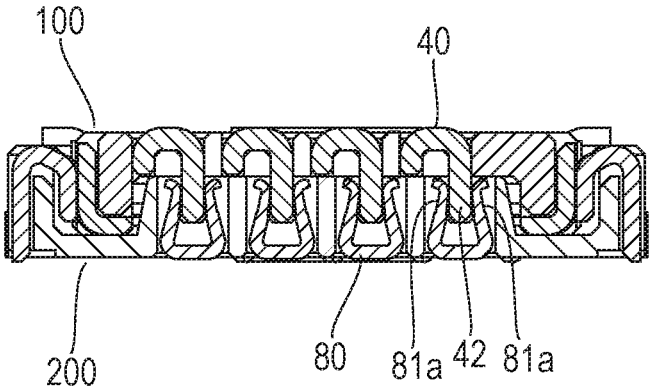
FIG. 17C is an enlarged sectional view taken along the 17C-17C line of FIG. 16B.

The row of the contact tabs 42 and the protrusions 27 and 28 which are aligned in the alignment direction in the plug 100 is inserted into the groove 65 of the receptacle 200, the contact tab 42 is pinched by the pair of contact pieces 81*a* of the socket contact 80 as illustrated in FIG. 17C, and the pin contact 40 and the socket contact 80 are thus connected with each other.

The lateral walls 22 and 23 of the plug 100, to which the metal fittings 50 are attached, are fitted and housed in a concave portion formed between the lateral walls 62 and 63, to which the metal fittings 90 of the receptacle 200 are attached, and the pedestal shaped portion 64. The metal fitting 50 of the plug 100 and the metal fitting 90 of the receptacle 200 are mutually brought into contact with desired contact force and thus conducted with each other on the protruding portions 92*a* formed on the metal fitting 90.

Since the spring portion 84 of the socket contact 80 is positioned on a position shunted from the groove 65 in the socket inter-row direction, the spring portion 84 is shifted from the contact tab 42 of the pin contact 40 in the socket inter-row direction and thus does not interfere with the contact tab 42 as illustrated in FIG. 17B.

The plug and the receptacle which are mounted on mounting surfaces of boards and mated with each other in the orthogonal direction to the mounting surfaces are described above, but a plug and a receptacle according to the present invention are not limited to the plug and the receptacle described above. A plug and a receptacle which are mounted on mounting surfaces of boards and mated with each other in the direction parallel to the mounting surfaces may be employed or a plug and a receptacle which are attached to cable terminals, for example, may be employed.

The foregoing description of the embodiment of the invention has been presented for the purpose of illustration and description. It is not intended to be exhaustive and to limit the invention to the precise form disclosed. Modifications or variations are possible in light of the above teaching. The embodiment was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A plug for mating with a receptacle, the plug comprising:

an insulator that has an inner bottom surface, the inner bottom surface being orthogonal to a mating direction of the plug; and a plurality of pin contacts secured to the insulator and aligned in an alignment direction, each of which includes a contact tab having a pair of planar surfaces of the contact tab on two mutually opposite sides thereof which are parallel to each other, the planar surfaces of the contact tab each forming a contact surface;

wherein the contact tabs stand up from the inner bottom surface in the mating direction, the contact surfaces being parallel to the alignment direction;

wherein a plurality of protrusions are formed in the insulator that stand up from the inner bottom surface in the mating direction, such that each of the protrusions is positioned between two of the contact tabs which are next to each other in the alignment direction;

wherein a projecting strip having a trapezoidal section and extending in the mating direction is formed on a lateral surface of the contact tab which faces the alignment direction, the lateral surface of the contact tab being opposed to a lateral surface of the protrusion adjacent to the contact tab in the alignment direction; and a groove having a trapezoidal section and extending in the mating direction is formed on the lateral surface of the protrusion, wherein the projecting strip is fitted into the groove.

2. The plug according to claim 1, wherein the protrusions each have a pair of planar surfaces of the protrusion on two mutually opposite sides thereof which are parallel to each other, the planar surfaces of the protrusion each being flush with the contact surfaces of the contact tab adjacent to the protrusion.

3. A receptacle for mating with a plug in a mating direction, the receptacle comprising:

a receptacle insulator; and a plurality of socket contacts that are secured to the receptacle insulator and aligned in a socket alignment direction;

wherein each of the socket contacts includes a contact portion, a coupling portion, a spring portion, and a fixing portion, which are continuously connected in this order, the contact portion includes a pair of contact pieces, the contact pieces being opposed to each other in an opposing direction and being elastically displaceable respectively in the opposing direction, the fixing portion is fixed to the receptacle insulator, and the spring portion renders the contact portion displaceable in a direction parallel to the opposing direction with respect to the fixing portion;

wherein the pair of contact pieces and the spring portion are protruded to a same side in the mating direction with respect to the coupling portion and are positioned to be mutually shifted in the socket alignment direction; and wherein a groove having both wall surfaces which are opposed to each other is formed on the receptacle insulator, the groove extending in the socket alignment direction, and each of the pair of contact pieces is positioned on each of the both wall surfaces.

4. The receptacle according to claim 3, wherein the pair of contact pieces and the spring portion are positioned to be mutually shifted in a direction parallel to the opposing direction and the spring portion is retreated from the groove.

5. A connector comprising:

a plug for mating with a receptacle, the plug comprising:

an insulator that has an inner bottom surface, the inner bottom surface being orthogonal to a mating direction of the plug; and a plurality of pin contacts secured to the insulator and aligned in an alignment direction, each of which includes a contact tab having a pair of planar surfaces of the contact tab on two mutually opposite sides thereof which are parallel to each other, the planar surfaces of the contact tab each forming a contact surface;

wherein the contact tabs stand up from the inner bottom surface in the mating direction, the contact surfaces being parallel to the alignment direction; and wherein a plurality of protrusions are formed in the insulator that stand up from the inner bottom surface in the mating direction, such that each of the protrusions is positioned between two of the contact tabs which are next to each other in the alignment direction; and the receptacle according to claim 3; wherein the spring portion is positioned on a position on which the spring portion does not interfere with the pin contact in mating of the plug and the receptacle.

* * * * *